United States Patent [19]

Langer et al.

[11] 4,305,992

[45] Dec. 15, 1981

[54] INTUMESCENT SHEET MATERIAL

[75] Inventors: Roger L. Langer; Alan J. Marlor, both of St. Paul, Minn.

[73] Assignee: Minnesota Mining and Manufacturing Company, St. Paul, Minn.

[21] Appl. No.: 97,953

[22] Filed: Nov. 28, 1979

[51] Int. Cl.[3] ..... B32B 19/06; B32B 27/04; B32B 29/06

[52] U.S. Cl. ..... 428/324; 106/DIG. 3; 162/159; 162/181 R; 428/332; 428/913; 428/920

[58] Field of Search ..... 428/271, 272, 236, 241, 428/920, 921, 324, 543, 292, 332; 162/153, 159, 181 R, 181 C, 156; 106/18.11, 18.16, DIG. 3; 252/8.1; 52/232

[56] References Cited

U.S. PATENT DOCUMENTS

| | | | |
|---|---|---|---|
| 3,455,850 | 7/1969 | Saunders | 106/18.11 |
| 3,654,073 | 4/1972 | Lard et al. | 162/159 |
| 3,824,297 | 7/1974 | Wada | 106/DIG. 3 |
| 3,916,057 | 10/1975 | Hatch et al. | 428/241 |

FOREIGN PATENT DOCUMENTS 1513808 6/1978 United Kingdom .

*Primary Examiner*—Paul J. Thibodeau
*Attorney, Agent, or Firm*—Cruzan Alexander; Donald M. Sell; Edward T. Okubo

[57] ABSTRACT

Flexible intumescent sheet materials having greatly decreased negative expansion characteristics in the range of 200° to 400° C. and which are thermally resistant and resilient after expansion are disclosed. The flexible intumescent sheets are particularly useful for mounting automotive catalytic converter monoliths.

7 Claims, No Drawings

INTUMESCENT SHEET MATERIAL

This invention relates to flexible intumescent sheet material having greatly decreased negative expansion characteristics in the range of 200° C. to 400° C. and which is thermally resistant and is resilient after expansion. The invention further relates to flexible intumescent sheet material useful as a packing for mounting and positioning automotive catalytic converter monoliths. Due to the relatively high temperatures encountered in the catalytic process, ceramic has been the natural choice for catalyst supports.

Ceramic bodies tend to be frangible and to have coefficients of thermal expansion differing markedly from those of metal containers. Thus, the mounting of the ceramic body in the container must provide resistance to mechanical shock due to impact and vibration and to thermal shock due to thermal cycling. Both thermal and mechanical shock may cause deterioration of the ceramic support which, once started, quickly accelerates and ultimately renders the device useless.

Flexible intumescent sheet materials particularly suited for use in the mounting of automobile exhaust catalytic converters have been developed. However, it has been discovered that such intumescent sheet materials, disclosed for example, in U.S. Pat. No. 3,916,057 and British Pat. No. 1,513,808, have a region of negative expansion beginning at about 100° C. and ranging up to 400° C. Because of the negative expansion characteristics of these sheet materials, it has been found that the mounted catalyst support may become loose in the temperature range of 100°–400° C. and until such time as the intumescent sheet material has passed through the negative expansion region and expanded sufficiently to recover to its original thickness.

Vermiculite is well known in the art for its ability to exfoliate thermally, by treatment with hydrogen peroxide or under the influence of microwaves, with an expansion in volume of as great as 20 fold (see e.g., U.S. Pat. Nos. 3,753,923, 3,758,415 and 3,830,892).

Sheet materials have heretofore been known including exfoliated or "popped" mica of either the synthetic type described in U.S. Pat. No. 3,001,571 or of vermiculite as described in U.S. Pat. Nos. 2,204,581 and 3,434,917. Insulating and accoustical sheet materials are described in U.S. Pat. No. 2,481,391 which contain expanded vermiculite, and a light-weight firebrick containing expanded vermiculite is disclosed in U.S. Pat. No. 2,509,315.

Intumescent compositions have been described employing unexpanded vermiculite in combination with various materials. Thus, U.S. Pat. Nos. 2,526,066 and 3,744,022 disclose plaster wall board compositions containing unexpanded vermiculite. The incorporation of the unexpanded vermiculite into the wall board provides additional fire resistance but dehydration of the gypsum and expansion of the vermiculite together result in rapid impairment of the integrity of the board.

Unexpanded vermiculite is utilized in a fire-retardant mastic coating in U.S. Pat. No. 3,090,764 and exfoliation serves as insulation when the coating is exposed to fire. Both expanded and unexpanded vermiculite are used in fire-protecting coatings of asphaltic compositions described in U.S. Pat. No. 3,556,819 and roofing materials containing layers of unexpanded vermiculite or other intumescent materials are disclosed in U.S. Pat. Nos. 2,782,129 and 3,365,322.

It is known that the microwave expansion of vermiculite is more effective in the presence of polar molecules, such as water, urea, thiourea or cations such as $Cu(NH_3)_4++$, $Na+$, $Li+$, $Co+$ or $NH_4+$.

It has now been found that when vermiculite is ion exchanged with $NH_4+$ cations and then combined with ceramic fibers in a papermaking operation, an intumescent sheet is formed which, when exposed to heat as from an engine exhaust, will intumesce (expand) at a temperature about 100° C. lower than a sheet containing untreated vermiculite, and that unexpectedly, the percent negative expansion is significantly reduced.

It has been found that a sheet material may be produced from thus treated unexpanded vermiculite, inorganic fibrous materials and binders to provide a desirable degree of wet strength. The sheet material can be produced to desirable thickness from about 0.5 to about 5 mm. by paper making techniques as will be described more fully hereinbelow.

Suitable binders can include various polymers and elastomers in latex form, as for example, natural rubber latices, styrene-butadiene latices, butadiene-acrylonitrile latices, latices of acrylate and methacrylate polymers and copolymers and the like. Suitable inorganic binders may include tetrasilicic fluorine mica in either the water-swelling unexchanged form or after flocculation as the exchanged salt with a di- or polyvalent cation as well as bentonite or fibrous materials such as asbestos. Organic and inorganic binders may be used in combination to produce sheet materials according to the present invention.

The flexible intumescent sheet material is utilized in automobile exhaust catalytic converters as a mounting material by expansion in situ. The expanded sheet then holds the ceramic core or catalyst support in place in the container or canister. The thermal stability and resilience of the sheet after exfoliation compensate for the difference in thermal expansion of the metal canister and the ceramic substrate, for vibration transmitted to the fragile device and for irregularities in the metallic or ceramic surfaces.

The sheet material may be formed by standard papermaking techniques, either hand laid or machine laid, taking suitable precautions to attain substantially uniform distribution of particles throughout the web. The sheet material may be provided with or temporarily laminated to a backing sheet of kraft paper, plastic film, non-woven synthetic fiber web or the like as desired. From 40 to 65% by weight of intumescent material, unexpanded treated flakes of vermiculite ore in particle sizes of from about 0.1 up to about 6 mm. and preferably up to about 2 mm. are combined in a large volume of water with solids in the proportions 25 to 50% inorganic fibrous materials, such as chrysotile or amphibole asbestos, soft glass fibers such as available under the tradename chopped E. glass, refractory filaments including zirconia-silica fibers, crystalline alumina whiskers and alumino-silicate fibers (available commercially under the tradenames Fiberfrax, Cerafiber and Kaowool) and 5 to 15% of binder as described above. Small amounts of surfactants, foaming agents and flocculating agents may also be added before forming the sheet.

Flocculation is conveniently achieved using electrolytes such as alum, alkali or acid. Small amounts of organic fibrous materials may be added to impart additional green strength to the green sheet material. The intumescent material, inorganic fibrous material and organic latex binder are blended together in a large volume of water, of the order of 5 to 100 times as much by weight and the flocculating agent or agents are added. A small amount of surfactant or foaming agent may also be employed in order to improve the dispersion of the intumescent material without going beyond the scope of the invention. In order to avoid the use of asbestos in making the sheet, because of possible health hazards associated with this material, substitution of glass fiber materials or refractory (glass or crystalline) filaments or whiskers is possible without impairing the quality of the sheet. In general, asbestos fibers are less expensive than other fibers.

The sheet is conveniently formed by standard papermaking techniques either in a hand-sheet former or Fourdrinier screen. The resulting green sheet is compressed to give a dry weight density of about 0.35 g./ml. or more, dried at about 90° C. to form a handleable, readily flexible, resilient, intumescent sheet material. A strip of the material about 2.5 mm. thick can be curved to a radius of 5 cm. without cracking.

Measurement of the usefulness of the intumescent sheet material of the invention involves its ability to expand and to generate and maintain sufficient force against casing and substrate so as to hold catalyzed ceramic substrates in metal containers and also its ability to absorb mechanical shock and to accommodate the differential dimensional changes resulting from thermal gradients. A method to test this thermal expansion behavior is summarized by the following procedure:

A 9.53 mm diameter sample of intumescent sheet material is placed in a Theta Dilatronic II (Model MFE-715) Thermal Mechanical Analyzer, available from Theta Industries, Inc., Port Washington, NY. A 1350 gram weight is applied on a sample area of 38.5 $mm^2$ giving an effective load of 0.345 $N/mm^2$. The sample thickness versus temperature is continuously recorded using an X-Y plotter. The most significant values are the maximum percent negative expansion, the temperature at which the intumescent sheet begins to expand and the maximum percent thermal expansion.

The following examples will more fully illustrate the best mode contemplated of practicing the invention.

EXAMPLE 1

A 5 gallon drum is filled with 3.6 gallons (30 lbs.) of water. 5 lbs. of ammonium dihydrogen phosphate ($NH_4H_2PO_4$) (available from Stauffer Chem. Co.) is added and agitated until the ammonium phosphate is dissolved, about 15 minutes. To this mixture 50 lbs. of unexpanded vermiculite ore (#4 grade Zonolite, available from W. R. Grace & Co.) is added and allowed to stand for fifteen hours after which the liquid is poured off and the vermiculite dried at 100° C. Twelve grams of the dried sample of treated vermiculite was placed in eight #10 crucibles. Each crucible was heat treated at a different temperature—225°, 250°, 275°, 300°, 325°, 350°, 375°, and 400° C. The contents of each crucible were transferred to a 50 ml graduated cylinder and the volume was determined to the nearest 0.5 cc. Volume expansions were calculated and are shown in comparison to untreated vermiculite in Table I.

TABLE I

| Volume Expansion of Vermiculite Ore | | |
|---|---|---|
| Expansion Temp. °C. | Treated % Expansion | Untreated % Expansion |
| 225 | 0 | — |
| 250 | 3.2 | — |
| 275 | 40 | — |
| 300 | 96.8 | −7.4 |
| 325 | 112.9 | −10.7 |
| 350 | 173.3 | −7.4 |
| 375 | 193.5 | 3.7 |
| 400 | 206.6 | 67.9 |

Next, 48 lbs. of alumina-silica ceramic fibers (washed Fiberfrax available from the Carborundum Co.) were mixed with water at a 1.5% solids, then pumped to a holding tank. To this mixture, 9.6 lbs. of a Hycar 1562X103 butadiene-acrylonitrile latex (available from B. F. Goodrich Chemical Co.) was added and precipitated with a 10% alum solution (sufficient to reduce the pH to a range of 4.5–5), then 50 lbs. of the $NH_4H_2PO_4$ treated vermiculite was added.

The resulting slurry was pumped out onto a moving vacuum wire belt and the water drawn off. The resulting sheet was dried and wound into rolls. It had a thickness of 1.3 mm and density of 0.53 $g/cm^3$.

Three thicknesses were stacked together and tested for expansion behavior over the range 0–750° C. This behavior is shown in Table II. At 240° C., the intumescent sheet has shown only a 3.6% decrease in thickness. At 240° C. expansion now begins and at 255° C. the thickness is equal to the starting thickness.

EXAMPLE 2

Water (1200 ml) is poured into a mixing chamber of a large Waring Blender and to it is added 15.4 grams of alumina-silica ceramic fiber (washed Fiberfrax available from Carborundum Co.) followed by vigorous agitation for about 20 seconds. Then there is added 3.3 gm of a butadiene-acrylonitrile latex binder as 8 gm of 40% solution (available as Hycar 1562X103 from B. F. Goodrich Chemical Co.) followed by agitation for 10 seconds, then the addition of 28 grams unexpanded vermiculite (No. 4 grade Zonolite from W. R. Grace & Co.) which had been chemically treated with ammonium phosphate (40 gms $NH_4H_2PO_4$ in 250 ml water to which 250 gms of #4 unexpanded vermiculite was added, then soaked for 18 hours, filtered, and dried at 100° C.). The fiber, latex and vermiculite slurry was further agitated for approximately 15 seconds. The latex is flocculated and at least partially deposited on the fibers by adding a small amount of 10% alum solution (sufficient to reduce the pH to a range of 4.5 to 5.0) to the slurry and mixed for about 10 seconds. The suspension is cast onto a hand former to give a hand sheet of about 19×20 cm, total area about 380 $cm^2$, which is dried. The sheet density averages 0.395 $gm/cm^3$ with a thickness of 2.8 mm. The sheet is flexible and can be rolled around a radius of 5 cm.

Expansion behavior of this sheet was tested and presented in Table II.

EXAMPLE 3

A solution of 80 grams of ammonium carbonate [$(NH_4)_2CO_3$—Mallinckrodt AR grade] in 250 ml water was prepared and 250 grams of unexpanded vermiculite ore (#4 Zonolite, W. R. Grace) was added. The vermiculite was soaked for 18 hours, then filtered and dried at 100° C. in a forced air oven. A hand sheet was prepared using the same procedures and forming techniques as in Example 2 except that the ammonium carbonate treated vermiculite was used. The resulting intumescent sheet had an average density of 0.414 gm/cm$^3$ and thickness of 2.87 mm. One thickness of the sample sheet was tested for expansion behavior. Results are shown in Table II.

EXAMPLE 4

An ammonium acetate solution was prepared for cation exchange of vermiculite. A total of 60 grams of $NH_4C_2H_3O_2$ (ammonium acetate available from Mallinckrodt, Inc.) was added to 250 ml of water and agitated. To the resultant solution, 250 grams of unexpanded #4 vermiculite ore was added and allowed to soak for 18 hours. The vermiculite slurry was filtered then dried at 100° C. A hand sheet was prepared using this ammonium acetate treated vermiculite as described in Example 2. The resulting intumescent sheet was flexible and had a density of 0.418 g/cm$^3$ and thickness of 2.84 mm. One thickness of the hand sheet was tested for expansion behavior and reported in Table II.

EXAMPLE 5

An ammonium hydroxide solution was prepared using 250 ml $NH_4OH$ (30% $NH_3$) available from Mallinckrodt, Inc., and 250 ml water to which 250 grams of #4 unexpanded vermiculite was added. The resultant slurry was soaked for 18 hours, then filtered and dried at 100° C. A hand sheet was prepared using the ammonium hydroxide treated unexpanded vermiculite ore as described in Example 2. The resulting flexible intumescent sheet had a density of 0.415 gms/cm$^3$ and thickness of 2.84 mm. Expansion behavior was determined and the data is presented in Table II.

EXAMPLE 6

A urea solution was prepared using 50 gms of $NH_2CONH_2$ (available as urea from Baker Chemicals) in 250 ml water to which 250 grams of #4 unexpanded vermiculite had been added. The resultant vermiculite slurry was soaked for 18 hours, then filtered and dried at 100° C. A handsheet was prepared using the urea treated unexpanded vermiculite as described in Example 2. The resulting intumescent sheet had a density of 0.466 gms/cm$^3$ and a thickness of 2.31 mm. Expansion behavior was determined and the data presented in Table II.

EXAMPLE 7

A urea solution was prepared using 150 gms of $NH_2CONH_2$ (available as urea from Baker Chemicals) in 250 ml of water to which 250 grams of #4 unexpanded vermiculite was added. The resultant vermiculite slurry was soaked for 18 hours, then filtered and dried at 100° C. A handsheet was prepared using the urea treated unexpanded vermiculite as described in Example 2. The resulting intumescent sheet had a density of 0.437 gms/cm$^3$ and a thickness of 2.39 mm. Expansion behavior was determined and the data presented in Table II.

TABLE II

| | INTUMESCENT SHEET EXPANSION BEHAVIOR | | | | | | | | | | | | |
|---|---|---|---|---|---|---|---|---|---|---|---|---|---|
| | PERCENT VOLUME EXPANSION @ °C. | | | | | | | | | | Max % Negative | Expansion | Temp at which |
| | 25 | 100 | 200 | 300 | 350 | 400 | 500 | 600 | 700 | 800 | Exp. | Temp | Exp = 0% |
| Sheet of U.S. Pat. No. 3,916,057 | 0 | −3.4 | −9.4 | −11.1 | −11.1 | −9.8 | 3.0 | 11.0 | 11.0 | 10.3 | −11.1 | 380 | 475 |
| Sheet of British Patent 1,513,808 | 0 | −4.9 | −12.6 | −15.0 | −15.3 | −11.3 | 26.2 | 45.6 | 50.5 | 47.6 | −15.3 | 385 | 425 |
| Example 1 $NH_4H_2PO_4$ | 0 | −0.9 | −3.6 | 20.9 | 31.8 | 45.5 | 61.8 | 67.3 | 69.1 | 66.4 | −3.6 | 245 | 255 |
| Example 2 $NH_4H_2PO_4$ | 0 | 0 | −3.2 | −4.7 | 27.1 | 32.8 | 55.6 | 68.9 | 71.7 | 64.1 | −4.7 | 310 | 320 |
| Example 3 $(NH_4)_2CO_3$ | 0 | −1.0 | −4.8 | −6.7 | 0 | 10.5 | 52.4 | 63.8 | 63.8 | 52.3 | −6.7 | 310 | 350 |
| Example 4 $NH_4C_2H_3O_2$ | 0 | −1.0 | −7.7 | −9.6 | 7.7 | 23.1 | 61.5 | 71.2 | 71.2 | 65.4 | −9.6 | 300 | 325 |
| Example 5 $NH_4OH$ | 0 | 0 | −6.6 | −9.4 | 45.3 | 50.9 | 61.3 | 66.0 | 66.0 | 57.7 | −9.5 | 300 | 315 |
| Example 6 $NH_2CONH_2$ | 0 | −9.5 | −13.7 | −12.6 | −3.2 | 19.0 | 52.6 | 61.1 | 65.3 | | −13.7 | 290 | 355 |
| Example 7 $NH_2CONH_2$ | 0 | −7.6 | −12.0 | 50.0 | 70.0 | 93.0 | 92.0 | 92.0 | 62.0 | 49.0 | −12.0 | 200 | 225 |

Examination of Table II will clearly show that the sheets of the present invention begin expanding at a much lower temperature than a representative prior art sheet, have significantly lower maximum percent negative expansion and return to their original starting thickness at significantly lower temperatures.

The sheet of British Pat. No. 1,513,808 is seen to have a maximum percent negative expansion (decrease in thickness) of 15.3% at 350° C. Expansion of the sheet began at 385° C. and at 425° C., its thickness equalled its starting thickness. It will be appreciated that the high percent negative expansion can cause a severe problem with a loose catalytic converter while and immediately after the automobile has been driven off the assembly line. Since the automobile is run for such a short time, the catalytic converter and the intumescent mounting sheet may not have had enough time to reach normal operating temperatures in the range of 500°–800° C. Temperatures in the range of 100°–400° C., however, are reached, which are sufficient to cause the intumescent mounting sheet to contract and pull away from the ceramic monolith due to the negative expansion characteristics of the sheet. The catalytic converter is now less tightly retained than at the time of assembly and extremely susceptible to damage from mechanical shock due to impact and vibration in the transportation and early driving phases. To overcome this severe problem, some automotive manufacturers have preheated the catalytic converter assemblies after fabrication but before mounting onto an automobile to insure that the intumescent mounting sheets had been properly expanded. This procedure has been unsatisfactory due to the high treating costs and the sacrifice to the appearance of the unmounted converter assemblies.

The intumescent sheets of the present invention have all but eliminated the need for such pretreatment of converter assemblies.

What is claimed is:

1. A flexible intumescent sheet useful for mounting automotive catalytic converter monoliths comprising from 40% to 65% by weight of unexpanded vermiculite flakes having particle sizes of from about 0.1 mm. to about 6 mm. treated by extended soaking in an aqueous ammonium solution and being substantially completely ion-exchanged with $NH_4+$ cations, from 25% to 50% by weight of inorganic fibrous material and from 5% to 15% of binder, said sheet upon exposure to heat from an engine exhaust being capable of undergoing thermal expansion, said sheet having a maximum percent negative expansion of about 10% at about 300° C. and returning to its original starting thickness or greater at about 350° C.

2. A flexible intumescent sheet according to claim 1 wherein the treated vermiculite is vermiculite which has been ion-exchanged with ammonium dihydrogen phosphate.

3. A flexible intumescent sheet according to claim 1 wherein the treated vermiculite is vermiculite which has been ion-exchanged with ammonium carbonate.

4. A flexible intumescent sheet according to claim 1 wherein the treated vermiculite is vermiculite which has been ion-exchanged with ammonium acetate.

5. A flexible intumescent sheet according to claim 1 wherein the treated vermiculite is vermiculite which has been ion-exchanged with ammonium hydroxide.

6. A flexible intumescent sheet according to claim 1 wherein the inorganic fibrous material is asbestos, soft glass fiber or refractory alumino-silicate fiber.

7. A flexible intumescent sheet according to claim 1 wherein the binder is an organic elastomeric material.

* * * * *

UNITED STATES PATENT AND TRADEMARK OFFICE

CERTIFICATE OF CORRECTION

PATENT NO. : 4,305,992

DATED : Dec. 15, 1981

INVENTOR(S) : Roger L. Langer and Alan J. Marlor

It is certified that error appears in the above—identified patent and that said Letters Patent is hereby corrected as shown below:

Column 1, line 41, after "3,758,415" add -- , 3,824,297 --.

Signed and Sealed this

*Twentieth* Day of *April 1982*

[SEAL]

*Attest:*

GERALD J. MOSSINGHOFF

*Attesting Officer*

*Commissioner of Patents and Trademarks*